US007284354B1

(12) United States Patent
Sorkin

(10) Patent No.: US 7,284,354 B1
(45) **Date of Patent: *Oct. 23, 2007**

(54) UPPER BEAM SLAB BOLSTER WITH EXTRUDED PLATES

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 129 days.

This patent is subject to a terminal disclaimer.

(21) Appl. No.: 11/073,262

(22) Filed: Mar. 7, 2005

Related U.S. Application Data

(63) Continuation-in-part of application No. 10/688,183, filed on Oct. 20, 2003.

(51) Int. Cl.
*E04C 5/16* (2006.01)

(52) U.S. Cl. ..... 52/687; 52/679; 52/677; 52/742.1; 404/134; 404/135; 404/136

(58) Field of Classification Search ..... 52/677, 52/687, 679, 742.1; 404/134, 135, 136
See application file for complete search history.

(56) References Cited

U.S. PATENT DOCUMENTS 1,277,612 A * 9/1918 Leonard ..... 52/679
4,942,714 A * 7/1990 Langley et al. ..... 52/687
5,655,349 A * 8/1997 Ghali et al. ..... 52/724.1
5,664,390 A 9/1997 Sorkin
D393,997 S * 5/1998 Hartzheim ..... D8/354
6,772,571 B1 8/2004 Sorkin
6,775,954 B1 8/2004 Sorkin
6,948,291 B2 * 9/2005 Haslem et al. ..... 52/677
7,108,453 B2 * 9/2006 Harris ..... 404/135
2002/0121065 A1 * 9/2002 Schulze ..... 52/677

FOREIGN PATENT DOCUMENTS

GB 2316961 A * 3/1998

* cited by examiner

*Primary Examiner*—Jeanette Chapman
*Assistant Examiner*—Dan Kenny
(74) *Attorney, Agent, or Firm*—Egbert Law Offices

(57) ABSTRACT

A bolster for use in construction has a beam, a first plurality of leg members on one side of the beam, a second plurality of leg members on an opposite side of the beam, a first plate having a receptacle on one side thereof and a second plate having a receptacle on one side thereof. The receptacle of the first plate receives a portion of the first plurality of leg members therein. The receptacle of the second plate receives a portion of the second plurality of leg members therein. The receptacles having a generally C-shaped cross section for resiliently contacting surfaces of the respective leg members. The plate is integrally formed of an extruded polymeric material.

13 Claims, 3 Drawing Sheets

UPPER BEAM SLAB BOLSTER WITH EXTRUDED PLATES

RELATED U.S. APPLICATIONS

The present application is a continuation-in-part of U.S. patent application Ser. No. 10/688,183, filed on Oct. 28, 2003, and entitled "Extruded Upper Beam Slab Bolster for Use in Construction", presently pending.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to bolsters that are used in construction activities for the support of post-tension cables, rebars or mesh. More particularly, the present invention relates to upper beam bolsters that are designed for support on underlying layers of mesh and rebar or on slab-on-grade surfaces. Additionally, the present invention relates to plates that can be attached to the existing bolsters so as to convert such bolsters for upper beam use. Additionally, the present invention relates to such plates for use with bolsters in which the plate can be formed by extrusion processes.

BACKGROUND OF THE INVENTION

Bolsters are commonly used in the construction industry for the support of post-tension cables, rebars, or mesh above a surface. Typically, when such materials are used, they must be supported above the surface when the concrete is poured. These bolsters are used with poured decks. In normal use, the bolster is positioned on the deck and includes a beam which extends across a plurality of leg members. This beam is formed so as to contact and support the rebar while the base of the bolster rests on the deck or on a grade. When the concrete is poured, the bolster will support the rebar a proper distance above the bottom surface.

In normal use, such bolsters are preformed so that they can be installed quickly and easily upon the deck. Conventionally, the preformed bolster will have a plurality of leg members and a steel rod welded to a top surface of each of the leg members. The rod will serve as a receiving area for the rebar. Conventionally, these bolsters are formed in preset lengths. If it is necessary to extend the bolster across a long surface of the deck, then the ends of the beams of adjacent bolsters will be wired together such that the bolsters are in an end-to-end relationship.

The most common bolster that is employed is a metal bolster manufactured by Meadow Steel Products of Tampa, Fla. This bolster has a plurality of inverted U-shaped leg members having outwardly extending foot portions. A rigid tubular rod having a slight waveform pattern formed thereon is welded to the middle of the inverted U-shaped leg members. Each of the leg members is generally arranged in parallel relationship to each other. The feet of each of the leg members will rest on the deck while the rebar is supported. After the concrete has solidified, and the deck is removed, the bottom surfaces of the feet will be exposed. As such, it is necessary to coat the feet with an anti-rust material. Alternatively, stainless steel material can be employed for the leg members and their associated feet.

Corrosion and cost are major problems affecting the bolster of Meadow Steel Products. In order to form such a bolster, a great deal of manufacturing must take place, including metal forming, bending, dipping, and welding. These activities, along with the cost of the material used to form the bolster, make the cost of the bolster relatively expensive. If the bolster is not coated or made of a stainless steel material, then corrosion can adversely affect the product. This corrosion can even occur when the metal is coated.

In the past, various attempts have been made to create bolsters of plastic material that can serve the purposes of the bolster of Meadow Steel Products. In general, such efforts have resulted in plastic chairs that are ineffective, cumbersome to use, or unable to properly withstand the forces imparted by the rebar upon the bolster. One such plastic bolster, manufactured by Conac, includes a central beam which is integrally formed with a plurality of leg members. Each of the leg members extends downwardly so as to present a flat surface to the underlying deck. No feet are provided which allow the bolster to be stapled to the deck. Additionally, the configuration of this Conac bolster allows for easy deformation. It is very difficult and time consuming to join lengths of the Conac bolster together. The Conac bolster also lacks the suitable wave form pattern for the receipt of the rebar on the top surface of the bolster. This plastic bolster is often broken, collapsed, or tipped over in actual use. The base of such a bolster has only a very small area of contact with the deck. As such, these plastic bolsters lack the strength and ability to withstand the loads imparted to them.

U.S. Pat. No. 5,664,390, issued on Sep. 9, 1997 to the present inventor, describes a bolster for use in construction. This bolster has a plurality of leg members arranged in parallel relationship and a beam integrally formed with the plurality of leg members and extending across the plurality of leg members. Each of the plurality of leg members has a foot for contacting the underlying surface. Each of the leg members includes a central body portion, a first leg extending downwardly from one side of the central body portion and a second leg extending downwardly from an opposite side of the central body portion. The foot is formed at an end of each of the first and second legs opposite the central body portion. The foot includes a plurality of pin-like projections extending outwardly from a bottom surface thereof. This bolster is of a type for stapling and fixed attachment to an underlying deck. However, under certain circumstances, it would be desirable to be able to use these bolsters for "upper beam" purposes. Upper beam bolsters are often used upon the top of mesh or layers of strands. The upper beam bolsters are commonly used in highway construction where multiple layers of steel are laid out. Under other circumstances, a widened or flat base is required for slab-on-grade construction. The relatively small and narrow feet would sink into sand or dirt if the bolsters of U.S. Pat. No. 5,664,390 were used for "upper beam" purposes. In other circumstances, upper beam slab bolsters are used on corrugating steel decking so as to be in flat surface-to-surface contact with such steel flat surfaces. As such, a need has developed so as to allow the bolster of U.S. Pat. No. 5,664,390 to be properly adapted for upper beam bolster purposes.

The present inventor has filed U.S. application Ser. Nos. 10/223,042 and 10/223,044 on Aug. 19, 2002 for plates for use with such upper beam slab bolsters. In each of these cases, the upper beam bolster that is used is of a type that is formed by injection molding. Whenever injection molding processes are used, the cost of preparing a die is relatively expensive. Ultimately, the cost of the die can determine the profitability or lack of profitability of a particular plate construction. In view of the limited application for such injection-molded plates for upper beam slab bolsters, it was found that the injection molding of such plates reduces the economic advantages associated with attaching a plate to an existing bolster. As such, a need developed in which to reduce the costs associated with the manufacture of such plates for upper beam slab bolsters.

It is an object of the present invention to provide an upper beam slab bolster that is corrosion-proof and relatively inexpensive.

It is another object of the present invention to provide an upper beam bolster which can be made from an easily assembled bolster and support plate.

It is another object of the present invention to provide an upper beam bolster that can withstand the forces imparted to it.

It is a further object of the present invention to provide an upper beam slab bolster that includes a bottom plate that can be formed through extrusion molding processes.

It is still a further object of the present invention to provide an upper beam bolster that is easy to manufacture and easy to use.

It is an object of the present invention to provide plates for use in association with upper beam bolsters that can be securely affixed to the leg members of the upper beam bolster.

It is still another object of the present invention to provide plates for use with upper beam bolsters which can provide a flat bottom surface below the bolster for supporting the bolster in a desired position upon an underlying surface.

These and other objects and advantages of the present invention will become apparent from a reading of the attached specification and appended claims.

BRIEF SUMMARY OF THE INVENTION

The present invention a bolster for use in construction that has a beam, a first plurality of leg members arranged in generally parallel spaced relationship on one side of the beam, a second plurality of leg members arranged in generally parallel spaced relationship on an opposite side of the beam, a first plate having a receptacle on one side thereof for receiving a portion of the first plurality of leg members, and a second plate having a receptacle on one side thereof suitable for receiving a portion of the second plurality of leg members therein. The beam extends transversely across the first and second plurality of leg members. The first plate has a flat surface positioned below the first plurality of leg members. The second plate also has a flat surface positioned below the second plurality of leg members.

Each leg member of the first and second pluralities of leg members has a central body portion and a leg extending downwardly from the central body portion. The leg member of the first plurality of leg members is in planar alignment with the leg member of the second plurality of leg members. Each leg member of the first and second pluralities of leg members has a foot formed at an end of the leg and extending horizontally outwardly therefrom. This foot has a top surface and a bottom surface. The receptacle of the first plate receives the foot of the first plurality of leg members therein. The receptacle of the second plate receives the foot of the second plurality of leg members therein. The surfaces of the receptacle resiliently contact the top and bottom surfaces of the foot so as to retain the respective plates on the respective feet of the leg members. The foot has a plurality of pin members extending downwardly therefrom. The plurality of pin members of the foot of the first plurality of leg members contacts the flat surface of the first plate. The plurality of pin members of the foot of the second plurality of leg members contacts the flat surface of the second plate.

In the present invention, each of the first and second plates is formed of an extruded polymeric material. The portions of the first and second pluralities of leg members are slidably received within the receptacles of the first and second plates.

The first plate has a lip extending upwardly from a side of the flat surface opposite the receptacle of the first plate. The second has a lip extending upwardly from a side of the flat surface opposite the receptacle of the second plate. In one embodiment of the present invention, the lip of the first plate abuts another portion of the first plurality of leg members. Similarly, the lip of the second plate abuts another portion of the second plurality of leg members.

In alternative embodiment of the present invention, the beam has a plurality of supports extending downwardly from an underside thereof and between the first and second pluralities of leg members. The lip of the first plate abuts a surface of the plurality of supports. The lip of the second plate abuts an opposite surface of the plurality of supports.

In the present invention, each of the receptacles of the first and second plates has a generally C-shaped cross section. The C-shaped cross section of the first plate will face the C-shaped cross section of the receptacle of the second plate. The flat surface of the first plate is co-planar with the flat surface of the second plate.

DETAILED DESCRIPTION OF THE INVENTION

Figure 1:
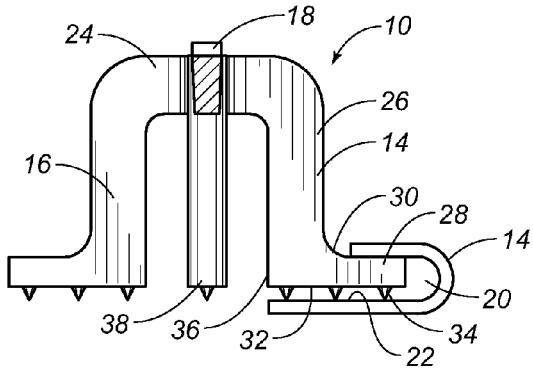
FIG. 1 is an end view showing the upper beam bolster in accordance with a preferred embodiment of the present invention.

Referring to FIG. 1, there is shown a bolster 10 for use in construction in accordance with preferred embodiment of the present invention. For the purposes of illustration, a first plate 12 is illustrated as secured to the leg member 14 of the bolster 10. In actual practice, another plate, similar to the plate 12, will be secured to the leg member 16 of the bolster 10. A beam 18 extends across the top of the leg members 14 and across the top of the leg members 16. The leg members 14 are arranged in generally parallel spaced relationship on one side of beam 18. The leg members 16 are arranged in generally parallel spaced relationship on the opposite side of the beam 18. The beam 18 extends transversely across the leg members 14 and 16.

The first plate 12 has a receptacle 20 on one side thereof. The receptacle 20 receives a portion of the leg members 14 therein. The first plate 12 has a flat surface 22 positioned below the leg members 14.

As can be seen in FIG. 1, each of the leg members 14 and 16 has a central body portion 24 and respective legs 26 extending downwardly from the central body portion 24. The leg member 14 will be in planar alignment with the leg member 16. The leg member 14 has a foot 28 formed at the end of the leg 14 and extending horizontal outwardly therefrom. The foot 28 has a top surface 30 and a bottom surface 32. The receptacle 20 of the first plate 12 receives the foot 28 of the leg members 14 therein. Specifically, one portion of the plate 12 resiliently contacts the top surface 30 of the leg member 14. Another portion of the first plate 12 resiliently contacts the bottom surface (or the associated pin members 34) of the leg 14. As can be seen in FIG. 1, the foot 28 has a plurality of pin members 34 extending downwardly therefrom. The bottoms of the plurality of pin members 34 contact the top of the flat surface 22 of plate 12.

As can be seen in FIG. 1, the plate 12 can be integrally formed of an extruded polymeric material. The foot 28 of the leg member 14 is slidably received within the receptacle 20 of the plate 12. The flat surface 22 will extend to the inner surface 36 of the leg 14.

The bolster 10 has a plurality of supports 38 extending downwardly from an underside of the beam 18. The supports 38 are positioned between the first plurality of leg members 14 and the second plurality of leg members 16. The end of the flat surface 22 is positioned inwardly away from the support 38.

Figure 2:
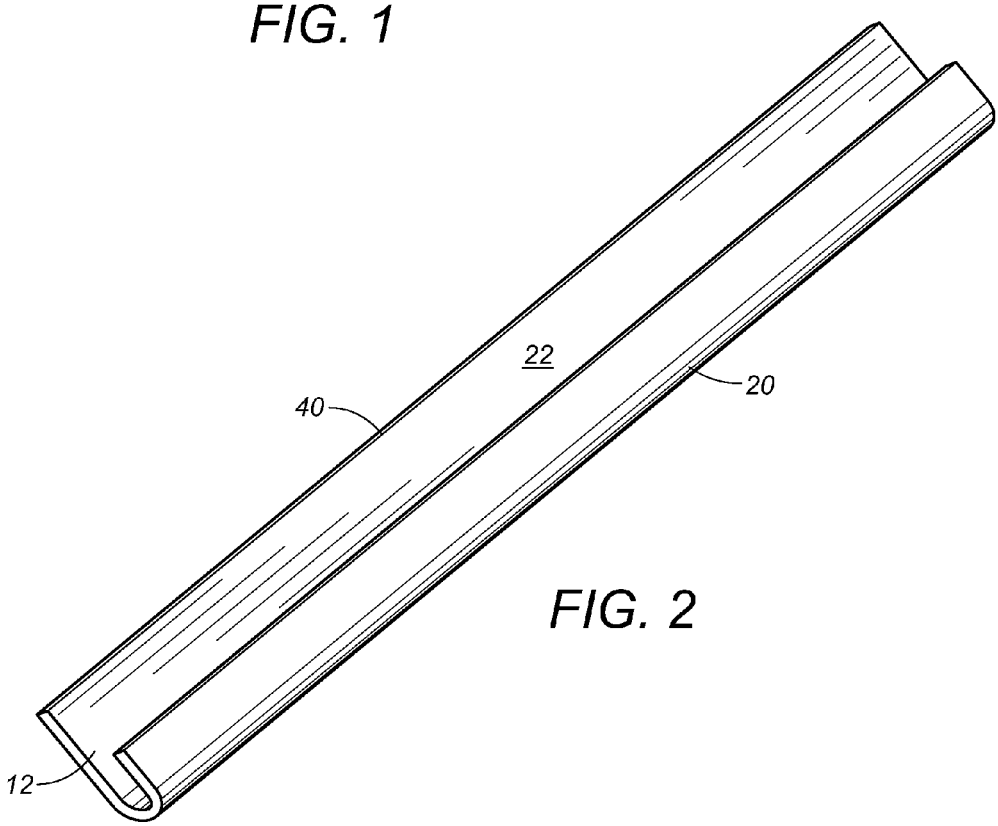
FIG. 2 is a perspective view of the first plate as attached to the upper beam bolster of the preferred embodiment of the present invention.

FIG. 2 shows an isolated view of the plate 12. The plate 12 is an elongate member that generally extends for the length of the bolster 10. The plate 12 has a receptacle 20 formed on one side thereof and extending for the length of the plate 12. The flat surface 22 extends from the receptacle 20 to an opposite side 40 of the plate 12. The receptacle 20 has a generally C-shaped cross section. The interior of the receptacle 20 has a size suitable for receiving the foot of the plurality of leg members therein.

Figure 3:
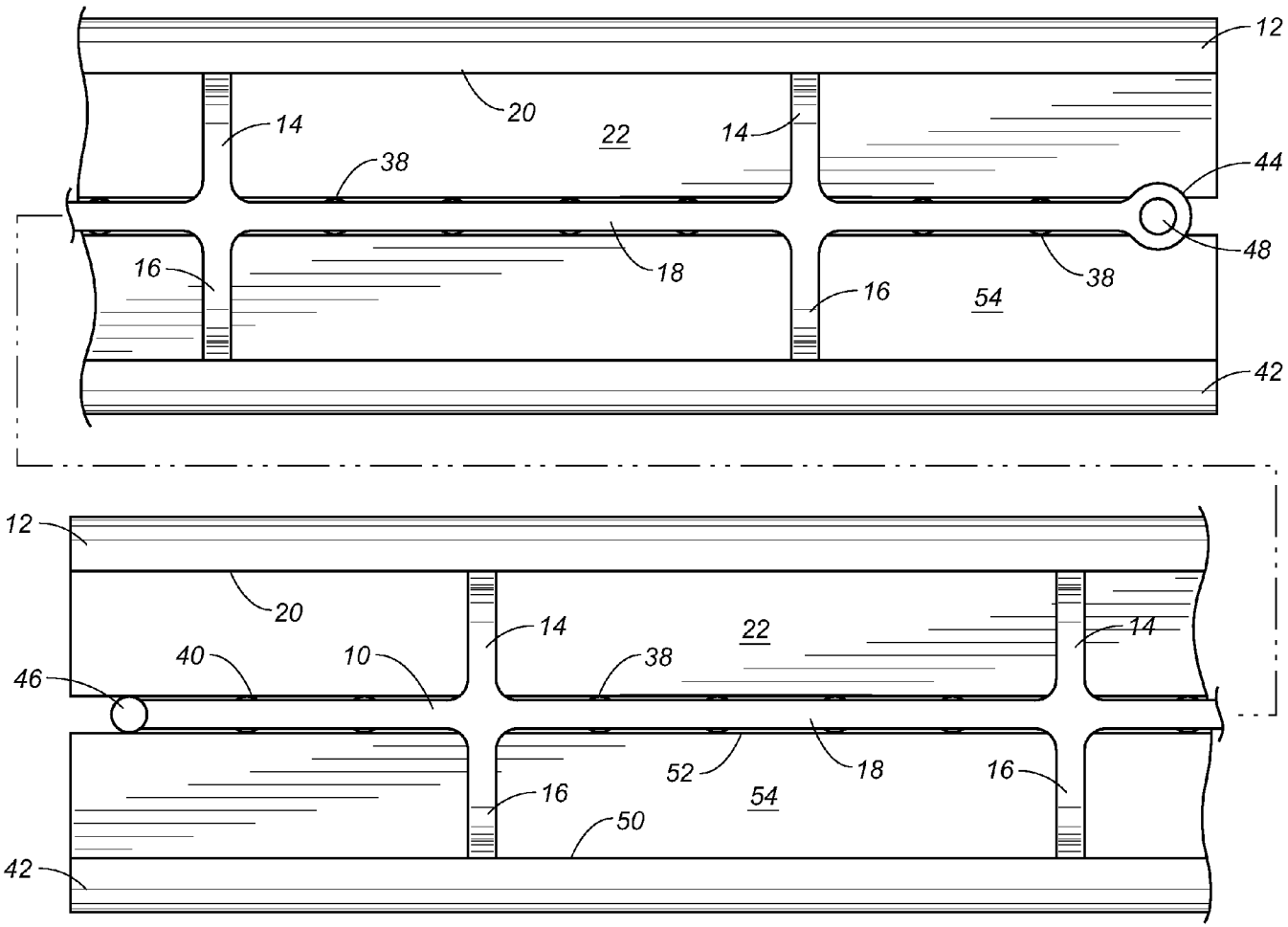
FIG. 3 is a plan view showing the application of the first and second plates to the upper beam bolster of the preferred embodiment of the present invention.

FIG. 3 shows the bolster 10 as secured to the beam member 18 and to another beam member 42. The bolster 10 includes the beam 18 extending along its length from the receptacle end 44 to the pin end 46. The receptacle end 44 is in the form of an annular member with a receiving hole 48. The receiving hole 48 is positioned in such a manner and configured in a such manner so as to properly receive the pin member 46 from the end of an adjacent bolster. The beam 18 has a first plurality of leg members 14 arranged in generally parallel spaced relationship to each other on one side of the beam 18. A second plurality of leg members 16 is arranged in generally parallel spaced relationship to each other and located on an opposite side of the beam 18. The first plurality of leg members 14 and the second plurality of leg members 16 extend transversely relative to the beam 18. Each of the first plurality of leg members 14 is in planar alignment with a corresponding leg member of the second plurality of leg members 16.

Each of the leg members 14 will have a foot portion which is received within the receptacle 20 of the first plate 12. Each of the second plurality leg members 14 will have a foot portion which is received within the receptacle 50 of the second plate 42. The beam 18 includes support member 38 which extends downwardly from the underside of beam 18. Each of the support members 38 is positioned between the inner side 40 of first plate 12 and the inner side 52 of second plate 42. The flat surface 22 of the first plate will be co-planar with the flat surface 54 of the second plate 42.

The constant cross-section of each of the plates 12 and 42 allows the plates 12 and 42 to be extrusion molded. As a result, each of the plates 12 and 42 can be made relatively simply with the same die. Plate 12 is identical to plate 42 and is fitted so that the receptacle 20 of plate 12 faces the receptacle 50 of plate 42. Each of the receptacles 20 and 50 will be snuggly and securely affixed around the top and bottom surfaces of the respective feet of the leg members 14 and 16.

Figure 4:
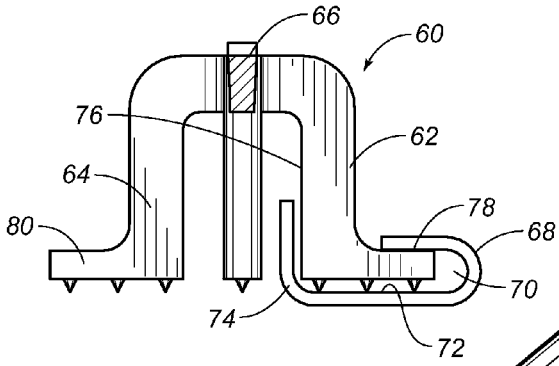
FIG. 4 is an end view showing an alternative embodiment of the upper beam bolster in accordance with the present invention.

Referring to FIG. 4, there is shown an alternative embodiment 60 of the upper beam bolster in accordance with the first alternative embodiment of the present invention. As can be seen, the bolster 60 includes a first plurality of leg members 62, a second plurality of leg members 64 and a beam 66 configured identically to that shown in FIG. 1. However, in FIG. 4, it can be seen that the plate 68 has a receptacle area 70, a flat bottom surface 72 and a lip 74 that extends upwardly from the flat bottom surface 72. The lip 74 is configured so as to generally fit against the inner surface 76 of the leg member 62. The upwardly turned lip 74 will extend upwardly for a height greater than the distance between the surface 78 and the flat bottom surface 72 of the plate 68. The upwardly turned lip 74 extends generally transversely to the flat bottom surface 72. An identical plate to that of plate 68 can be secured over the foot member 80 of the second plurality of leg members 64.

Figure 5:
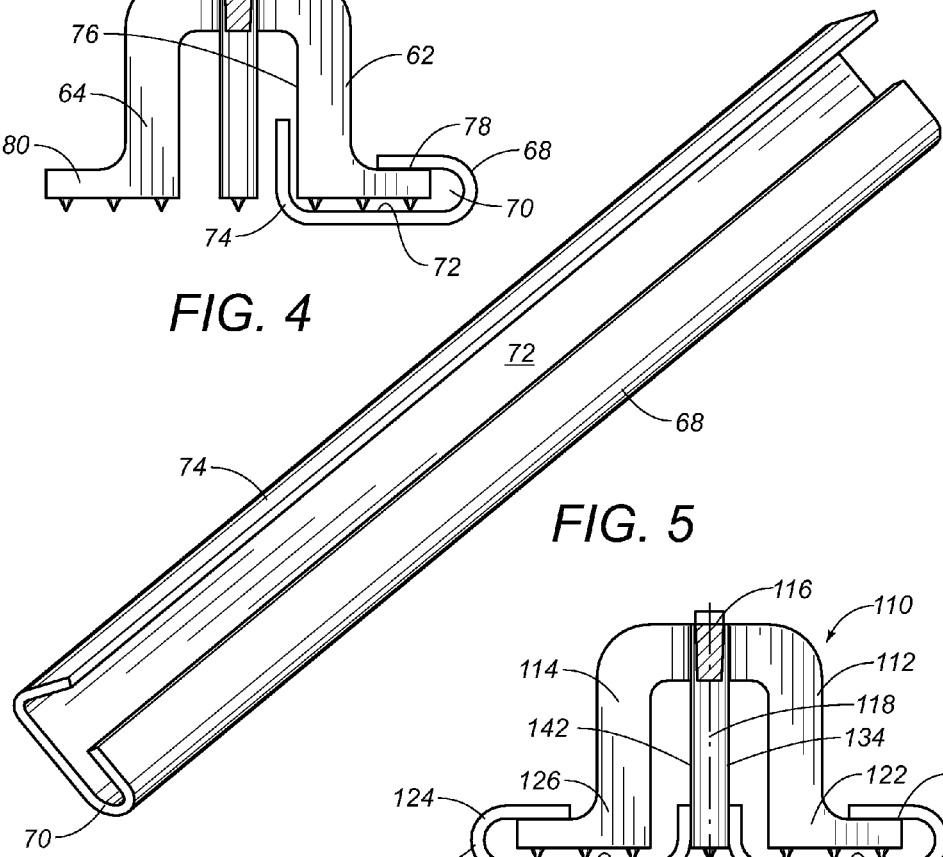
FIG. 5 is a perspective view showing the alternative embodiment of the plate as used with the upper beam bolster of FIG. 4.

FIG. 5 illustrates the plate 68. As can be seen, the plate 68 includes the receptacle 70, the flat bottom surface 72 and the upwardly turned lip 74. The receptacle 70 has a generally C-shaped cross section.

Figure 6:
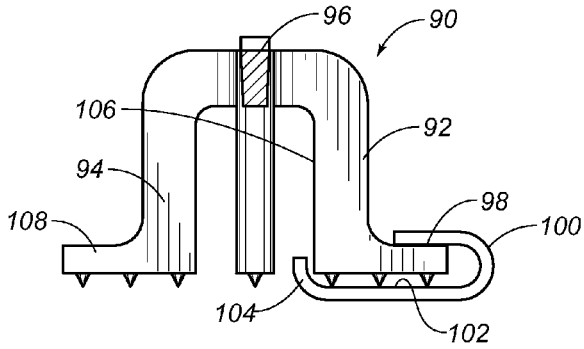
FIG. 6 is an end view showing a second alternative embodiment of the upper beam bolster in accordance with the present invention.

FIG. 6 illustrates a second alternative embodiment of the upper beam bolster 90 of the present invention. Upper beam bolster 90 has a first plurality of leg members 92, a second plurality of leg members 94 and a beam 96 configured in manner similar to that of the previous embodiment shown in FIGS. 1 and 4. In FIG. 6, however, the plate 98 includes a receptacle area 100, a flat bottom surface 102 and an upwardly turned lip 104. The upwardly turned lip 104 extends only slightly upwardly from the flat bottom surface 102 so as to overlap the bottom edge 106 of the leg member 92. Another plate, identical to that of plate 98, can be secured to the foot member 108 of the second plurality of leg members 94.

Figure 7:
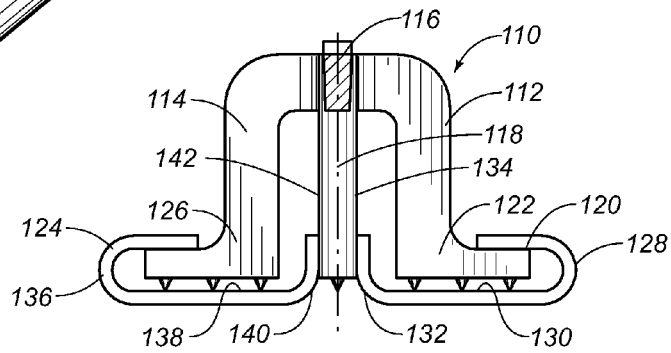
FIG. 7 is an end view showing a third alternative embodiment of the upper beam bolster in accordance with the present invention.

FIG. 7 illustrates a third alternative embodiment 110 of the upper beam bolster of the present invention. As can be seen, the upper beam bolster 110 has a first plurality of leg members 112, a second plurality of leg members 114 and a beam 116 extending therebetween. A support post 118 extends downwardly below the beam 116 generally between the first plurality of leg members 112 and the second plurality of leg members 114. A first plate 120 is secured over the foot 122 of the first plurality of leg members 112. A second plate 124 is secured over the foot 126 of the second plurality of leg members 114. First plate 120 has a receptacle area 128 extending around the end of the foot 122. A flat bottom surface 130 will extend below the bottom of the foot 122. An upwardly turned lip 132 resiliently contacts an inner surface 134 of the support 118. The second plate 124 also includes a receptacle area 136 which extends over the top and bottom surfaces of the foot 126. A flat surface 138 extends below the bottom surface of the foot 126 so as to reside in co-planar relationship with the flat bottom surface 130 of the first plate 120. An upwardly turned lip 140 resiliently contacts an opposite side 142 of the post 118. In this manner, each of the plates 120 and 124 is securely mounted onto the respective feet 122 and 126 of the respective plurality of leg members 112 and 114 of the bolster 110.

In each of the embodiments of the present invention, each of the plates has a constant cross section along the entire length of the plate. As such, the respective plates can be extrusion molded at minimal cost. Each of the plates can be easily slidably fastened over the respective feet of the bolsters so as to be in a desired position. As a result, these plates can be applied to the bolster at any convenient location. Since each of the plates is formed of a polymeric material, it will not corrode or be damaged by contact with ambient elements.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A bolster for use in construction comprising:

a beam;

a first plurality of leg members arranged in generally parallel spaced relationship on one side of said beam;

a second plurality of leg members arranged in generally parallel spaced relationship on an opposite side of said beam, said beam extending transversely across said first and second pluralities of leg members;

a first plate having a receptacle on one side thereof, said receptacle receiving a portion of said first plurality of leg members therein, said first plate having a flat surface positioned below said first plurality of leg members; and a second plate separate from said first having a receptacle on one side thereof, said receptacle of said second plate receiving a portion of said second plurality of leg members therein, said second plate having a flat surface positioned below said second plurality of leg members.

2. The bolster of claim 1, each leg member of said first and second pluralities of leg members comprising:

a central body portion; and a leg extending downwardly from said central body portion.

3. The bolster of claim 2, the leg member of said first plurality of leg members being in planar alignment with the leg member of said second plurality of leg members.

4. The bolster of claim 2, each leg member of said first and second pluralities of leg members further comprising:

a foot formed at an end of said leg and extending horizontally outwardly therefrom, said first foot having a top surface and a bottom surface, said receptacle of said first plate receiving the foot of said first plurality of leg members therein, said receptacle of said second plate receiving the foot of said second plurality of leg members therein.

5. The bolster of claim 4, said receptacle of said first plate having a surface resiliently contacting said top surface of the foot therein, said receptacle of said first plate having another surface resiliently contacting the bottom of said foot, said receptacle of said second plate resiliently contacting said top surface of the foot therein, said receptacle of said second plate resiliently contacting said bottom surface of foot therein.

6. The bolster of claim 4, said foot having a plurality of pin members extending downwardly therefrom, said plurality of pin members of the foot of said first plurality of leg members contacting said flat surface of said first plate, said plurality of pin members of the foot of said second plurality of leg members contacting said flat surface of said second plate.

7. The bolster of claim 1, each of said first and second plates being formed of an extruded polymeric material.

8. The bolster of claim 1, said portion of said first and second pluralities of leg members being slidably received respectively within said receptacles of said first and second plates.

9. The bolster of claim 1, said first plate having a lip extending upwardly from a side of said flat surface opposite said receptacle of said first plate, said second plate having a lip extending upwardly from a side of said flat surface opposite said receptacle of said second plate.

10. The bolster of claim 9, said lip of said first plate abutting another portion of said first plurality of leg members, said lip of said second plate abutting another portion of said plurality of leg members.

11. The bolster of claim 9, said beam having a plurality of supports extending downwardly from an underside thereof and between said first and second pluralities of leg members, said lip of said first plate abutting a surface of said plurality of supports, said lip of said second plate abutting an opposite surface of said plurality of supports.

12. The bolster of claim 1, said receptacle of said first plate having a C-shaped cross section, said receptacle of said second plate having a generally C-shaped cross section, said C-shaped cross section of said receptacle of said first plate facing said C-shaped cross section of said receptacle of said second plate.

13. The bolster of claim 1, said flat surface of said first plate being co-planar with said flat surface of said second plate.

* * * * *